United States Patent [19]

Kai et al.

[11] 4,229,507

[45] Oct. 21, 1980

[54] METHOD FOR DRYING WOOD MATERIAL

[75] Inventors: Tamotsu Kai, Saitama, Japan; Michio Tsurumi, Midland, Mich.; Takashi Sakakiyama, Yokohama; Kunihiro Horiuchi, Chiba, both of Japan

[73] Assignee: Asahi-Dow Limited, Tokyo, Japan

[21] Appl. No.: 7,590

[22] Filed: Jan. 29, 1979

[30] Foreign Application Priority Data

| | | | |
|---|---|---|---|
| Feb. 17, 1978 | [JP] | Japan | 53-16613 |
| Feb. 17, 1978 | [JP] | Japan | 53-16614 |
| Nov. 24, 1978 | [JP] | Japan | 53-144244 |

[51] Int. Cl.[3] ..... B27K 5/02

[52] U.S. Cl. ..... 428/541; 34/9.5; 34/13.4; 34/13.8; 428/537

[58] Field of Search ..... 34/9.5, 13.4, 13.8, 34/16.5; 428/541, 537

[56] References Cited

U.S. PATENT DOCUMENTS

| | | | |
|---|---|---|---|
| 2,395,311 | 2/1946 | Woodhouse et al. | 428/541 |
| 3,675,336 | 7/1972 | Dedrick | 34/9.5 |
| 3,726,709 | 4/1973 | Garratt et al. | 428/541 |

*Primary Examiner*—John J. Camby

*Attorney, Agent, or Firm*—Cushman, Darby & Cushman

[57] ABSTRACT

A dry wood material free from seasoning check is produced with good yield from undried wood material with water content of 50 to 200% by drying the undried wood material while controlling the rate of evaporation of water from the undried wood material by providing on its surface a barrier layer having a water vapor permeability in the specific range from 10 to 100 g/m$^2$.day.

22 Claims, No Drawings

METHOD FOR DRYING WOOD MATERIAL

This invention relates to a method for drying a wood material for production of a dry wood material free from seasoning check and also to a wood material controlled in the rate of evaporation of water from the surface thereof which is suitable for production of such a dry wood material. The "dry wood material free from seasoning check" herein used means a dry wood material substantially prevented from formation of check (i.e. cracks) on seasoning (i.e. drying in the air or under compulsory drying conditions) on the surface and ends thereof.

Raw wood materials generally contain about 50 to 200% by weight of water based on the weight thereof. When a wood cut down is left to stand in the air, the water in the vicinity of the surface of the wood is evaporated, whereby the water internally bound in the wood is diffused toward the surface to supplement the water evaporated. As the progress of drying, however, the rate of diffusion of the water from the innerside cannot keep pace with the water evaporation rate from the surface. As the result, there is formed between the surface and the inner portion of the wood a water content gradient or a pressure gradient. Such a gradient generally functions to permit the internally bound water to diffuse toward the surface. But, in case of wood materials, the rate of diffusion is relatively low as compared with that of the surface evaporation. Accordingly, when drying is performed under more severe drying conditions or under exposure at local portions directly to the sunlight or the air stream, the rate of diffusion cannot pace up with evaporation on the surface to cause excessive drying and shrinkage only on the surface. The so called seasoning check is considered to be formed according to such a mechanism.

The yields in the lumber industry are very low in case of both needle-leaved and broad-leaved trees, namely 60 to 80% and 50 to 60%, respectively. Such low yields are due to various reasons, but among them the damages caused by the aforesaid seasoning check amount to a very high percentage. Therefore, it is not too much to say that overcoming of this drawback is the greatest problem to be solved in the industrial field of wood materials, including lumber industry.

In the prior art, there have been made several proposals to overcome the problem as mentioned above. For example, (A) the end portions of a wood are previously sealed with a resin having a strong water resistance and tannin contained in the wood is converted to natural resin by the catalytic effect of a saturated aqueous potassium secondary phosphate solution impregnated under pressure into the wood, followed by natural drying with said end portions being cut off (Japanese published examined patent application No. 14437/1970). Alternatively, (B) a material such as a paint or wax is coated on the surface of a wood and the coated wood is subjected to heating and pressurization treatment to be impregnated with said material (Japanese published unexamined patent application No. 134804/1974). There is also a method (C) wherein a melamine resin is coated on the end portions of a wood and the coated wood is subjected to compulsory drying by means of a micro-wave oven (Japanese published unexamined patent application No. 76405/1976). According to the method (A), the polymerization reaction of tannin by the catalytic action of the saturated aqueous potassium secondary phosphate solution proceeds very slowly and it will take several months before completion of the reaction under normal atmospheric conditions. Further, the process is accomplished in multi-steps and an expensive high pressure equipment is required to be used. Due to such drawbacks, the method (A) cannot be a practically effective method. Also in the method (B), similarly expensive pressurizing and heating means are necessary for the purpose of effecting impregnation of the coated materials deep into the wood. In the method (C), while it is intended for drying deep portions in the wood, drying proceeds from the surface due to compulsory drying through conduction heat and therefore fails to give a decisive effect for preventing seasoning check. Even if there may be some effect, this method is economically disadvantageous since it is required to use a micro-wave oven and cannot practically be used. For the reasons set forth above, none of these methods are successful in practical applications. Furthermore, treatments of wood materials have been proposed from various aspects such as prevention against stain, decay, fungi and insect attack (see, for example, Canadian Pat. No. 913524, German laid-open patent application No. 2702924), prevention of bluing of wood (see French Pat. No. 2,057,365) and improvement of the surface conditions for finish coatings (see French Pat. No. 2,275,510). But all of these prior art are intended for purposes other than prevention of seasoning check in raw wood materials. Thus, it is still desirable to have an economical and practical method for prevention of seasoning check which frequently occurs in undried wood materials on drying.

An object of the present invention is to provide a method for drying a wood material to produce a dry wood material free from seasoning check.

Another object of the present invention is to provide a wood material controlled in the rate of evaporation of water from the surface thereof which is suitable for production of a dry wood material free from seasoning check.

Still another object of the present invention is to provide a dry wood material free from seasoning check which is prepared by such a method.

According to the present invention, in its broadest aspect, there is provided a method for drying a wood material to produce a dry wood material free from seasoning check, which comprises drying an undried wood material having a water content of from 50 to 200 wt.% while controlling the rate of evaporation of water from said undried wood material by providing on the surface of said undried wood material a barrier layer having a water vapor permeability in the range from 10 to 100 g/m$^2$.day (as measured under the condition of the relative humidity of 90% at 37.8° C.).

The method of the present invention is based in principle on an entirely unexpected discovery that there is formed substantially no crack in the wood material which is dried from wet wood material, when such drying is effected while controlling the rate of evaporation of water from the surface of the wet wood material at 10 to 100 g/m$^2$.day (as measured under the condition of the relative humidity of 90% at 37.8° C.). For practicing the method of the invention, there is provided a barrier layer having a specific water vapor permeability of 10 to 100 g/m$^2$.day on the surface of an undried wood material with water content of 50 to 200 wt.%. The barrier layer is required to permit transmission of water vapor through the layer at the rate within the specified range and may be prepared from various materials, which are not specifically limited, according to various conventional methods. According to the present invention, such a barrier layer is found to be readily formed by applying a treating agent containing a polymeric substance in the form of a solution, a suspension or an emulsion in a medium on the surface of the wood material by way of, for example, dipping coating or spraying, and then evaporating the medium to form a continuous polymeric film. Among them, an aqueous emulsion of a polymeric substance, especially one having a minimum film-forming temperature in the range from 0° to 40° C. is found to be most suitable from various standpoints such as easy applicability, low cost, no harmful effect causing pollution, etc.

The wood material prepared according to the preferred embodiment of the invention as mentioned above is a novel and useful intermediary product for production of the final dry wood material free from seasoning check. This product is then subjected to drying in the air, optionally with heating, to produce a dried wood material with less than 50 wt.% water content. Such an intermediary product, while the inner wood material may still be in the state of undried or semi-dried state, can be subjected to a long-term storage or transportation on board, without suffering from seasoning check as is observed in the conventional wood materials having no such barrier layer. Thus, the present invention also provides a novel wood material controlled in the rate of evaporation of water from the surface thereof, comprising an undried wood material having a water content of from 50 to 200 wt.% and a barrier layer provided on the surface of said wood material in an amount of 10 to 200 g (dry weight) per square meter of the surface area, said barrier layer being a continuous film having a water vapor permeability in the range from 10 to 100 g/m$^2$.day (as measured under the condition of the relative humidity of 90% at 37.8° C.).

In the wood material controlled in the rate of water vapor transmission (hereinafter referred to as "treated wood material") provided by the present invention, the barrier layer is preferably provided substantially all over the surface of the undried wood material. Namely, substantially all the surface area of the wood material should preferably be covered with the polymeric material film closely contacted thereon. The wording "substantially all the surface area of the wood material" herein used means the total surface area of the portions which are directly exposed to the air. Therefore, the surface areas of the portions at which wood materials are faced to each other as in case of an integrally combined bundle of lumbers are excluded. Thus, the percentage of the total film area relative to the total surface area of the wood material is preferably 100% to obtain favorable results. However, in some cases, presence of a partly exposed surface area is permissible depending on the water content of the wood material as well as from economical standpoint. In such a case, however, presence of a defect with too much surface area is not preferable since such a defect may cause seasoning check. Accordingly, the surface area of each exposed portion, if any, should be at most not more than 5 cm$^2$. When such defective exposed surface areas are permissible, the percentage of the surface area on which the polymeric film is covered based on the total surface area should be at least 60%, preferably 80% or more.

The film to be provided on the wood material of the present invention is required to have a water vapor permeability of 10 to 100 g/m$^2$ per day under the conditions as specified above. When the water vapor permeability through the film exceeds 100 g/m$^2$ per day, there is no effect for preventing the wood material from seasoning check irrespective of whether any species of wood or lumber may be used. On the contrary, with a water vapor permeability less than 10 g/m$^2$ per day, the rate of drying is too small, whereby there may ensue the problem of the quality of the resultant wood material due to insufficient degree of drying or the economical problem due to excessively prolonged drying time.

The exact mechanism in which the treated wood material according to the present invention is prevented from seasoning check has not so far been elucidated. But, while being not bound by any theory, it is speculated as follows. Generally speaking, wood materials contain 50 to 200% by weight of water based on their own weight. Among them, the water content of 30 to 40% corresponds to the bound water which is bound to the tissue of a wood material, while the water content in excess of 30 to 40% to the free water which is not bound to the tissue. When an undried wood material is left to stand in the air, there occurs first evaporation of the free water from the surface of the wood material. In order to supplement the evaporated water, the water present in the inner portion of the wood material is diffused toward the surface. But, if evaporation of the free water from the surface of the wood material is very rapid, supplement of the water from the inner portion of the wood material cannot pace up with the evaporation of the water. As the result, the water content in the surface layer of the wood material will become approximately the critical content of 30 to 40% which is the boundary value between the bound water and the free water. Subsequently, the bound water will be evaporated to cause shrinkage of the surface layer. Although the free water is still held in the inner portion of the wood material, the surface layer commences to be shrinked due to loss of the bound water. In such a case, the shrinkage stress becomes ununiformly distributed throughout the wood material, whereby there may be caused cracks on the surface layer of the wood material. Such a phenomenon is frequently observed when the wood material is dried under severe artificial drying conditions, under direct sunlight exposure or while being exposed partially to a strong air stream. The treated wood material of the present invention has the aforesaid film thereon and therefore there occurs no rapid evaporation of water from the surface thereof but water can sufficiently be supplemented to the surface layer. Thus, while the free water is still held in the inner portion of the wood material, no bound water is evaporated from the surface layer. Accordingly, the treated wood material of the present invention can be free from the situation in which only the surface layer undergoes shrinkage to cause crack formation.

The amount of the polymeric film provided on the wood material after drying is generally from 10 g/m$^2$ to 200 g/m$^2$, which is variable depending on the nature of the polymeric film formed from the emulsion. Accordingly, the thickness of the film is generally from about 10 to 200$\mu$.

The starting wood material to be used in the present invention may include a log from which bark may be peeled off, a primarily worked square, cylindrical or board lumber, other lumbers in any shape. The species of the trees from which these wood material are obtained are not specifically limited and both domestically produced and imported wood materials are available. Further, the wood material may be either single or a mass of plural wood materials. Especially, there may be used an integrally combined bundle of lumbers in the shape of square lumber or board lumber, etc. In such a bundle, only the exposed outer surface of the lumbers is required to have the polymeric film covered thereon and the other surfaces contacted with each other may be left to be free from such covering. The suitable size of the wood material to be used in the present invention is at least 3000 $cm^3$ in volume (e.g. 10 $cm^2$ in cross-sectional area and 3 m in length). The upper limit is not limited, but in case of combined lumbers, the total volume can be as much as 20 $m^3$ or more.

The film having the above characteristics can be formed preferably from an aqueous emulsion of a polymeric substance, namely an emulsion of a polymeric substance having desirably a minimum film-forming temperature of from 0° to 40° C. The polymeric emulsion mentioned in the present invention refers to an aqueous dispersion in which particles of a natural or synthetic polymer substance are stably dispersed, including all of those generally referred to as latex or emulsion. Furthermore, it also emcompasses compositions containing these polymeric emulsions as principal ingredient together with other additive components. The polymeric emulsion to be used in the present invention generally contains 30 to 70 wt.%, preferably 40 to 60 wt.%, of solid polymeric substance. If desired, there may also be incorporated thickeners or dispersing agents such as methyl cellulose, carboxylated methyl cellulose, polyvinyl alcohol, polyacrylic acid salts, casein, starch, etc., water-resistant agents such as melamine-formalin resin, urea-formalin resin, etc., anti-oxidants, fungicides or anti-staining agents, or others.

The polymeric emulsion to be used for the treated wood material of the present invention is desired to have a minimum film-forming temperature which is not higher than 40° C. If the minimum film-forming temperature exceeds 40° C., it is difficult to form a film at room temperature or, even if a film may be formed, cracks may be formed on the film surface to make it difficult to control the water vapor transmission as intended by the present invention, whereby no effect for preventing the wood material from seasoning check is recognized. The minimum film-forming temperature of a polymeric emulsion in the present invention is measured according to the temperature gradient plate method as described in Protzman et al, Journal of Applied Polymer Science 4, 81, 1960.

Typical examples of the polymeric emulsion having the minimum film-forming temperature within the specified range are natural rubber latex, styrene-butadiene copolymer latex (e.g. copolymer latex comprising 33 wt.% butadiene, 65 wt.% styrene and 2 wt.% acrylic acid), acrylonitrile-butadiene copolymer latex (e.g. copolymer latex comprising 38 wt.% acrylonitrile and 62 wt.% butadiene), methyl methacrylate-butadiene copolymer latex (e.g. copolymer latex comprising 42 wt.% methyl methacrylate and 58 wt.% butadiene), other synthetic rubber copolymer latex such as polyisobutylene copolymer latex polychloroprene copolymer latex, etc., polyvinyl acetate emulsion, ethylene-vinyl acetate copolymer emulsion (e.g. copolymer emulsion comprising 28 wt.% ethylene and 72 wt.% vinyl acetate), acrylic acid ester copolymer emulsion (e.g. copolymer emulsion comprising 45 wt.% methyl methacrylate and 55 wt.% ethyl acrylate), styrene-acrylic acid ester copolymer emulsion (e.g. copolymer emulsion comprising 55 wt.% styrene and 45 wt.% butyl acrylate), and other emulsions such as acrylic acid ester-vinyl acetate copolymer emulsion, polyvinyl chloride emulsion, vinyl chloride-vinylidene chloride copolymer emulsion, and so on.

The polymeric film may be formed on the wood material according to various methods such as dipping, roll coating, blade coating, spraying, depending on the shape, size of the wood material to be treated and the amount to be applied.

According to one preferred embodiment for applying the polymeric emulsion on the wood material, there is coated on the surface of a wood material a composition containing as principal film-forming ingredient an aqueous emulsion of a copolymer, comprising 30 to 95 wt.% of vinyl acetate and 5 to 70 wt.% of a mono-olefinic monomer (e.g. ethylene) obtained by emulsion copolymerization, having pH of 3.5 to 7.0, said copolymer having a glass transition temperature of 20° C. or higher.

According to another preferred embodiment, there is coated on the surface of a wood material a composition containing as principal film-forming ingredient a copolymer latex obtained by emulsion polymerization of 28 to 70 wt.% of an aliphatic conjugated diolefin (e.g. butadiene), 30 to 72 wt.% of an alkenyl aromatic monomer (e.g. styrene) and 0 to 42 wt.% of a mono-olefinic monomer (e.g. acrylonitrile, acrylic acid, methyl methacrylate, etc. copolymerizable with these monomers.

The present invention is further illustrated with reference to the following Examples, which are set forth only for illustrative purpose and should not be construed as limitative of the invention.

EXAMPLE 1

A mixture comprising 33 wt. parts of butadiene, 65 wt. parts of styrene, 2 wt. parts of acrylic acid, 0.7 wt. part of sodium persulfate, 100 wt. parts of deionized water, 1.0 wt. part of sodium dodecylbenzene sulfonate and 0.2 wt. part of t-decyl mercaptan is subjected to emulsion copolymerization in an autoclave at 80° C. for 6 hours. The resultant emulsion is adjusted to pH 6.0 and the latex solid content to 48 wt.% to prepare a copolymer latex. This latex is found to have a minimum film-forming temperature of 17° C.

This latex is coated manually using a roller brush on the surface of Western hemlock lumber containing 55% of water with dimensions of 200 mm in thickness, 250 mm in width and 3000 mm in length in an amount of 120 $g/m^2$ (as solid content, hereinafter the same) so as to cover 80% of the total surface area. This coated lumber is provided as test sample. The film thickness is 124$\mu$. The same film is formed under the same conditions on an uncoated kraft paper and subjected to natural drying at 23° C., humidity of 60% for 24 hours. This film is peeled off and subjected to measurement under the humidity of 90% at 37.8° C. according to the cup method (ASTM E-96-63T), whereby its water vapor permeability is found to be 26 $g/m^2$.day.

The above coated lumber sample is exposed to direct sunlight in outdoors for three months in summer time from June to August in Japan (hereinafter referred to merely as "outdoor exposure") to observe the state of deterioration of the film on the test sample such as decoloration or crack formation. There is observed neither decoloration nor check in the film. The dried lumber test sample (water content=29%) is also found to be free from any seasoning check either on the ends or on the surface.

COMPARISON EXAMPLE 1

The same Western hemlock lumber as used in Example 1 is subjected without application of the coating to the outdoor exposure test under the same conditions as in Example 1. As the result, after 7 days' outdoor exposure, seasoning check is observed to be formed on the ends and the surface of the lumber.

EXAMPLE 2

Example 1 is repeated except that the amount coated is changed to 40 g/m$^2$, the percentage of the coated area to 100% (total surface coating) and the water vapor permeability to 80 g/m$^2$.day. When the resultant coated lumber test sample is subjected to the outdoor exposure test, there is formed no seasoning check even after three month's exposure (water content=18%).

EXAMPLE 3

The same styrene-butadiene copolymer latex as used in Example 1 is applied by roller brush on the total surface area of a regular square lumber of cedar with dimensions of 105 mm both in thickness and width and 3000 mm in length in an amount of 80 g/m$^2$ to a film thickness of 82$\mu$. This film is found to have a water vapor permeability of 40 g/m$^2$.day. After the outdoor exposure test conducted for this coated test sample, there is found no seasoning check (water content=25%).

COMPARISON EXAMPLE 2

Example 3 is repeated except that the coated amount is changed to 30 g/m$^2$, the film thickness to 31$\mu$ and the water vapor permeability to 104 g/m$^2$.day. The resultant test sample is subjected to the outdoor exposure test for two months, whereby there is formed seasoning check on the surface.

COMPARISON EXAMPLE 3

The same cedar lumber as used in Example 3 is subjected without treatment to the outdoor exposure test, whereby there are formed seasoning check on both the ends and the surface of the test sample after three days.

EXAMPLE 4

A latex having a minimum film-forming temperature of 5° C. comprising 50 wt.% butadiene and 50 wt.% styrene with solid content of 49% and pH 7 is coated on the entire surface of the same Western hemlock as used in Example 1 by roller brush in an amount of 80 g/m$^2$ to a film thickness of 80$\mu$. This film is found to have a water vapor permeability of 35 g/m$^2$.day. There is formed no seasoning check on the dried wood when this test sample is subjected to the outdoor exposure test for three months (water content=25%).

EXAMPLE 5

An ethylene-vinyl acetate copolymer emulsion (Sumica Flex 500, trade mark, product of Sumitomo Chemical Co., Ltd., Japan; solid content=55%, pH=5.5, minimum film-forming temperature=10° C.) is coated by roller brush on the same Western hemlock lumber as used in Example 1 in an amount of 25 g/m$^2$ to a film thickness of 22$\mu$ with the coated surface area percentage of 90%. The coated film is found to have a water vapor permeability of 46 g/m$^2$.day. No seasoning check is found to be formed on the dried wood material (water content=20%), when the test sample is subjected to the outdoor exposure for three months.

COMPARISON EXAMPLE 4

When Example 5 is repeated by changing the amount coated to 10 g/m$^2$, the film thickness to 8$\mu$, the coated area to 100% and the water vapor permeability of the film to 110 g/m$^2$.day under otherwise the same conditions as in Example 5, there is formed seasoning check on the surface after two month's outdoor exposure.

COMPARISON EXAMPLE 5

A vinylidene chloride-vinyl chloride copolymer latex (Saran latex X-302, trade mark, product of Asahi-Dow Limited, Japan; solid content=50%, pH=5.0, minimum film-forming temperature=18° C.) is coated by roller brush on the entire surface of the same Western hemlock lumber as used in Example 1 in an amount of 40 g/m$^2$ to a film thickness of 50$\mu$. The coated film is found to have a water vapor permeability of 4.0 g/m$^2$.day. The coated test sample is subjected to the outdoor exposure test for three months. As the result, there is no seasoning check formed on the surface, but the test sample remained undried (water content=52%) and some mold is found to be generated partially on the lower part of the lumber with dark decoloration.

EXAMPLE 6

Comparison example 5 is repeated except that the amount coated is changed to 10 g/m$^2$, the film thickness to 13$\mu$ and the water vapor permeability to 36 g/m$^2$.day. As the result, there is found neither seasoning check nor mold in the dried lumber (water content=25%) after the outdoor exposure test for three months.

EXAMPLE 7

A natural rubber latex (solid content=60%, pH=11, minimum film-forming temperature=12° C.) is coated by roller brush on the entire surface of the same lumber of cedar as used in Example 3 in an amount of 50 g/m$^2$ to a film thickness of 50$\mu$. The coated film is found to have a water vapor permeability of 35 g/m$^2$.day. There is formed no seasoning check on this coated test sample after the outdoor exposure test continued for three months (water content=26%).

COMPARISON EXAMPLE 9

A styrene-acrylic acid ester copolymer emulsion comprising 75 wt.% of styrene and 25 wt.% of butyl acrylate (solid content=50%, pH=8.3, minimum film-forming temperature=61° C.) is coated by roller brush on the surface of the same Western hemlock lumber as used in Example 1 in an amount of 100 g/m$^2$.day to a film thickness of 95$\mu$. This coated film has a number of cracks and its water vapor permeability cannot be measured. The coated test sample is found to suffer from seasoning check on the end and surface after three day's outdoor exposure test.

EXAMPLE 8

Seventy regular square cedar lumbers as used in Example 3 (10 arrays in seven layers) are integrally combined in a bundle by three strips of iron bands with width of 25 mm at three sections in the longitudinal direction. Over the both end faces, both side faces and both upper and lower faces of the thus formed bundle is sprayed the same styrene-butadiene copolymer latex as used in Example 1 in an amount of 80 g/m$^2$ to a film thickness of 82$\mu$ with the coated area percentage based on the total area of the both end faces and side faces being 74%. The coated film is found to have a water vapor permeability of 40 g/m$^2$.day. After the three month's outdoor exposure test conducted for this coated lumber bundle, there is found no seasoning check on the ends or the surface of each of the lumbers either on the surface or internal of the bundle (water content=32% for outside lumber, 25% for innerside lumber).

What we claim is:

1. A method for drying a wood material, which comprises drying an undried wood material having a water content of from 50 to 200 wt.% while controlling the rate of evaporation of water from said wood material by providing on the surface of said wood material a continuous polymeric film barrier layer having a water vapor permeability in the range from 10 to 100 g/m$^2$.day (as measured under the condition of the relative humidity of 90% at 37.8° C.).

2. A method according to claim 1, wherein the wood material is a log, a primarily worked square, cylindrical or board lumber or a mass of these lumbers.

3. A method according to claim 2, wherein the wood material is an integrally combined bundle of two or more square or board lumbers.

4. A method according to claim 1, wherein the polymeric film is made of a copolymer of vinyl acetate with a mono-olefinic monomer.

5. A dry wood material free from seasoning check with less than 50 wt % water content, which is prepared according to claim 4.

6. A method according to claim 1, wherein the polymeric film is made of a copolymer of an aliphatic conjugated diolefin monomer with an alkenyl aromatic monomer or a copolymer of these monomers with another mono-olefinic monomer.

7. A dry wood material free from seasoning check with less than 50 wt. % water content, which is prepared according to claim 6.

8. A method according to claim 1, wherein the continuous polymeric film is formed by applying a treating agent containing a polymeric substance in the form of a solution, a suspension or an emulsion in a medium on the surface of the wood material and then evaporating the medium to form the continuous film.

9. A dry wood material free from seasoning check with less than 50 wt. % water content, which is prepared according to claim 8.

10. A method according to claim 8, wherein the treating agent is applied by dipping, coating or spraying.

11. A method according to claim 8, wherein the treating agent is in the form of an aqueous emulsion.

12. A method according to claim 11, wherein the aqueous emulsion has a minimum film-forming temperature in the range from 0° to 40° C.

13. A dry wood material free from seasoning check with less than 50 wt.% water content, which is prepared according to claim 12.

14. A dry wood material free from seasoning check with less than 50 wt % water content, which is prepared according to claim 1.

15. A wood material controlled in the rate of evaporation of water from the surface thereof, comprising an undried wood material having a water content of from 50 to 200 wt.% and a barrier layer provided on the surface of said wood material in an amount of 10 to 200 g (dry weight) per square meter of the surface area, said barrier layer being a continuous polymeric film having a water vapor permeability in the range from 10 to 100 g/m$^2$.day (as measured under the condition of the relative humidity of 90% at 37.8° C.).

16. A wood material according to claim 15, wherein the undried wood material is a log, a primarily worked square, cylindrical or board lumber or a mass of these lumbers.

17. A wood material according to claim 16, wherein the undried wood material is an integrally combined bundle or two or more square or board lumbers.

18. A wood material according to claim 15, wherein the polymeric film is made of a copolymer of vinyl acetate with a mono-olefinic monomer.

19. A wood material according to claim 15, wherein the polymeric film is made of a copolymer of an aliphatic conjugated diolefin monomer with an alkenyl aromatic monomer or a copolymer of these monomers with another mono-olefinic monomer.

20. A wood material according to claim 15, wherein the continuous polymeric film is formed from a solution, a suspension or an emulsion of a polymeric substance in a medium.

21. A wood material according to claim 20, wherein the polymeric film is formed from an aqueous emulsion.

22. A wood material according to claim 21, wherein the aqueous emulsion has a minimum film-forming temperature in the range from 0° to 40° C.

* * * * *